US007891875B1

(12) United States Patent
Feldman

(10) Patent No.: US 7,891,875 B1
(45) Date of Patent: Feb. 22, 2011

(54) TEAR-RESISTIVE CONTAINER FOR DISPENSING MATERIALS

(76) Inventor: Leonard Feldman, 1030 Seminole Dr., Fort Lauderdale, FL (US) 33304

( * ) Notice: Subject to any disclaimer, the term of this patent is extended or adjusted under 35 U.S.C. 154(b) by 749 days.

(21) Appl. No.: 11/233,656

(22) Filed: Sep. 23, 2005

(51) Int. Cl.
*B65D 33/22* (2006.01)
*B65D 33/00* (2006.01)
*B65D 30/22* (2006.01)

(52) U.S. Cl. ..... 383/119; 383/200; 383/207; 383/38

(58) Field of Classification Search ..... 383/119, 383/207, 200, 201, 203, 77, 62, 38, 40; 222/541.6; 229/311
See application file for complete search history.

(56) References Cited

U.S. PATENT DOCUMENTS 2,071,926 A * 2/1937 Geerlings ..... 428/124
3,217,971 A * 11/1965 Shvetz ..... 383/203
3,480,198 A * 11/1969 Repko ..... 383/203
3,741,778 A * 6/1973 Rowe ..... 426/107
3,873,735 A * 3/1975 Chalin et al. ..... 426/87
4,004,397 A * 1/1977 Hoffman et al. ..... 53/453
5,171,617 A * 12/1992 Affolderbach et al. ..... 428/34.9
5,360,854 A * 11/1994 Bozich, Jr. ..... 524/274
6,244,467 B1 * 6/2001 Lewit ..... 222/541.6
6,702,462 B2 * 3/2004 Richardson ..... 383/200
2001/0014187 A1 * 8/2001 Takahashi et al. ..... 383/200
2003/0152300 A1 * 8/2003 Tu et al. ..... 383/207
2006/0048497 A1 * 3/2006 Bloch ..... 57/230

FOREIGN PATENT DOCUMENTS

EP 1508530 A1 * 2/2005

* cited by examiner

*Primary Examiner*—Jes F Pascua
(74) *Attorney, Agent, or Firm*—Fitch, Even, Tabin & Flannery; John M. Naber

(57) ABSTRACT

A container is configured to store and dispense a material. More specifically, the container includes a top portion that is configured to be partially torn from a body portion of the container to dispense the material. The container includes a reinforced side portion that resists tearing. The tear-resistive portion may incorporate a strand (or thread) that is significantly more difficult to tear, as compared to the container, itself. In an implementation, the container may includes two hollow portions—a first portion for storing material and a second portion for securing the resistive thread. The two hollow portions may be separated by a crimped portion of the container. In other implementations, front and rear portions of the container may be glued together to create the two hollow portions. Alternately, the lateral edges of the front and rear surfaces of the container may be fused to create the tear-resistive portion.

6 Claims, 5 Drawing Sheets

230
235
220
215
225
200
210

430
435
420
415
425
400
410

TEAR-RESISTIVE CONTAINER FOR DISPENSING MATERIALS

FIELD OF THE INVENTION

The invention is directed to an improved container for dispensing materials. More specifically, the invention advantageously reduces the amount of litter associated with containers after they have been opened.

BACKGROUND OF THE INVENTION

Conventionally, users open containers by tearing a top portion of the packet from a central container body. For example, according to one container implementation, a sweetener packet is opened by tearing a top portion of the packet completely from the central packet body. This process creates unnecessary waste that is easily dispersed as litter. The litter issue is exacerbated by the fact that people generally use multiple packets as food is being consumed. For example, often consumers will use more than one ketchup packet on their French fries or more than one sweetener packet in their coffee. After being opened, the packet pieces are often set to the side of the table, where they are easily brushed off the table top and dispersed as litter.

In certain implementations such as ketchup, syrup, or honey packets, a small amount of the stored product may remain in a piece of the packet that is torn completely from a main body portion of the packet. If the separated piece of the packet is not properly disposed of, the stored product may be distributed from the separated piece and create a mess, resulting in an employer using additional resources to collect the separate container portions and clean the mess.

This issue is also illustrated in implementations directed to disposable medical containers. For example, disposable containers may be used to store medical instruments in a sanitized solution. In such applications, the sanitary solutions held within the containers may be hazardous or semi-hazardous substances. Therefore, it is even more critical to ensure that these containers are properly disposed of to prevent exposure to potentially dangerous materials.

Moreover, customer satisfaction may be adversely affected if litter is not promptly and properly disposed of. Furthermore, over the course of a day, the additional litter may translate into increased labor maintenance costs for employers. Therefore, in a market such as food dispensing containers, a slight reduction in the amount of litter produced correlates to a significant increase in employee efficiency and workplace cleanliness.

SUMMARY OF THE INVENTION

Accordingly, it is an object of the invention to create a container that is configured to dispense various materials, while reducing the litter produced when a consumer uses the container. The container is configured so that when opened, the container remains a single piece (i.e., a top portion of the container that has been torn open remains attached to the container).

In an embodiment of the invention, the container is configured as a rectangular container, wherein a top portion of the container is configured to be torn to open the container. The container includes a reinforced side portion that resists tearing. In an embodiment of the invention, the reinforced portion incorporates a strand (or thread) that is significantly more difficult to tear, as compared to the container.

According to an implementation, the resistive portion of the container includes two hollow portions—a first portion for holding the product; and a second portion for holding the resistive thread. The two hollow portions may be separated by a crimped portion of the container. In other implementations, front and rear portions of the container may be glued together to produce the two hollow portions. In yet another embodiment, lateral edges of the front and rear surfaces of the container may be fused to create the tear-resistive portion.

DETAILED DESCRIPTION OF THE INVENTION

For illustrative purposes only, the invention is described implemented as a sweetener packet embodiment. However, it is to be understood, that the invention may be implemented in any number of shapes and adapted for use with solids or liquids, food products (e.g., sweetener, sugar, ketchup, syrup, etc. . . . ) or non-food products (e.g., shampoo, soap, hair-care products, moist towelettes, medical instruments . . . ) or any other number of materials or products.

Figure 1:
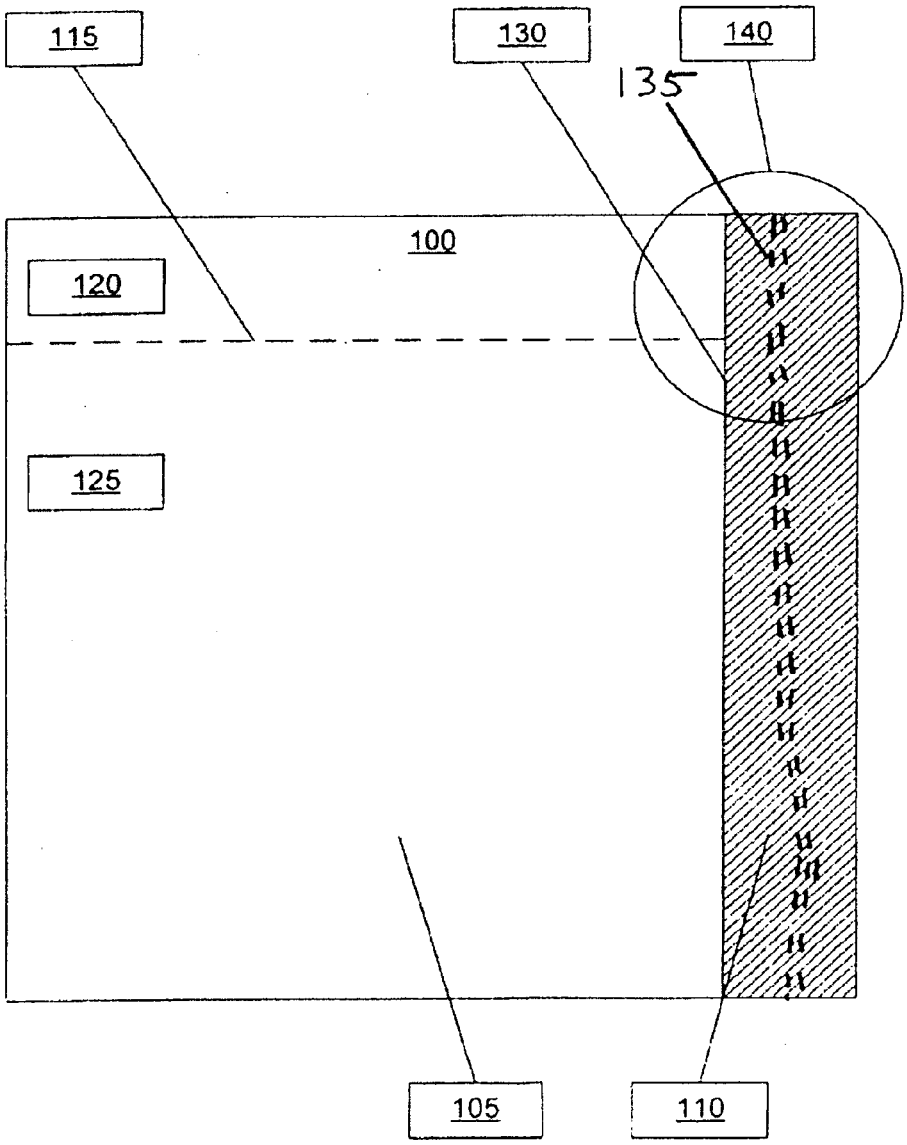
FIG. 1 is a diagram of a resistive container according to an embodiment of the invention.

As described above, an embodiment of the invention is directed to a resistive container that is configured to dispense products when opened, while remaining a single unit after being opened. According to an embodiment of the invention illustrated in FIG. 1, the container may be formed as a rectangular container 100 with a tear resistive portion. In FIG. 1, the resistive portion is implemented by creating a second hollow portion 110 within container 100. A first hollow portion 105 is used to store the product within the container and, as such, is configured to use most of the container's available volume. Second hollow portion 110 is used to secure a tear resistive thread along a lateral edge of the container. Accordingly, when the container is opened, for example along line 115, the tear-resistive thread 135 prevents a top portion 120 of the container from being removed from a central body portion 125 of the container 100.

Figure 2:
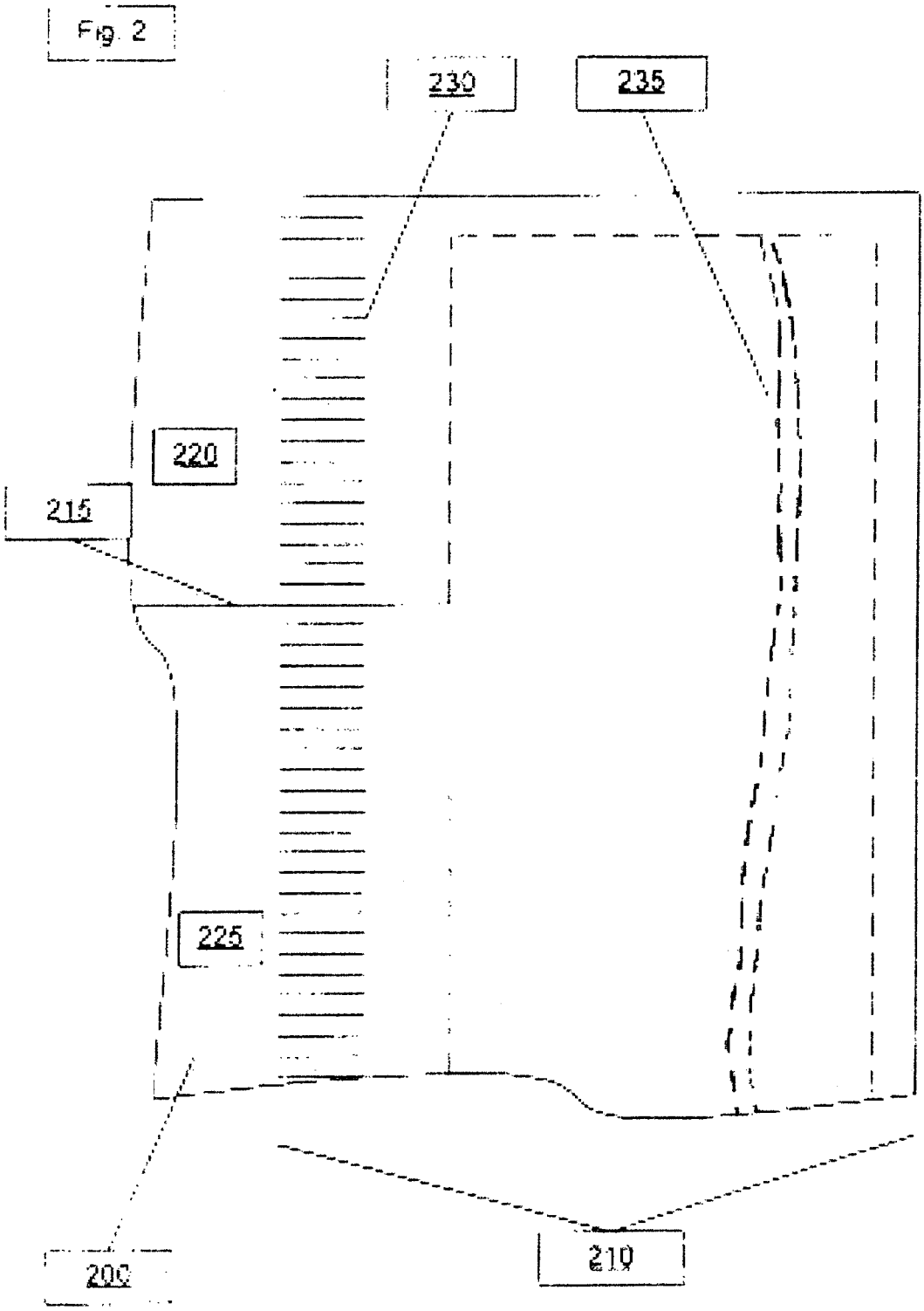
FIG. 2 illustrates a close-up view of a torn portion of the resistive container illustrated in FIG. 1.

FIG. 2 illustrates a close-up view of the resistive portion taken from area 140 illustrated in FIG. 1. More specifically, the implementation of FIG. 2 illustrates forming the second hollow portion 210 (110 in FIG. 1) by crimping the container along a vertical axis 230 (corresponds to 130 in FIG. 1) and inserting a tear-resistant thread 235 into the second hollow portion 110. In order to maximize the first hollow portion's product storage capacity the second hollow portion's 110 is minimized. It is noted that, in the present specification and figures, elements of the present invention are labeled with a three digit number, the first digit referring to the figure number, the second two digits referring to the specific element. Thus, for example, element 115 in FIG. 1 is element 215 in FIG. 2, element 315 in FIG. 3, element 415 in FIG. 4, and element 515 in FIG. 5.

It is to be understood that the resistive thread may be formed from any number of materials. For example, the tear-resistive thread may be formed from synthetic or natural fibers or any type of blended materials. It is to be understood that these materials may include, but are not limited to plastic, nylon, a heavy stock paper, foil, and/or foil-paper combination.

Alternately, instead of inserting a resistive thread, the resistive portion is formed by fusing the front and rear walls of the container together along the vertical axis 130 using glue or some other type of bonding material. As such, the glue may act to prevent tearing of the top portion 120 from the central body 125. In yet another embodiment, the lateral edge of the container 100 is reinforced to prevent tearing of top portion 120 from the central body portion 125.

Figure 3:
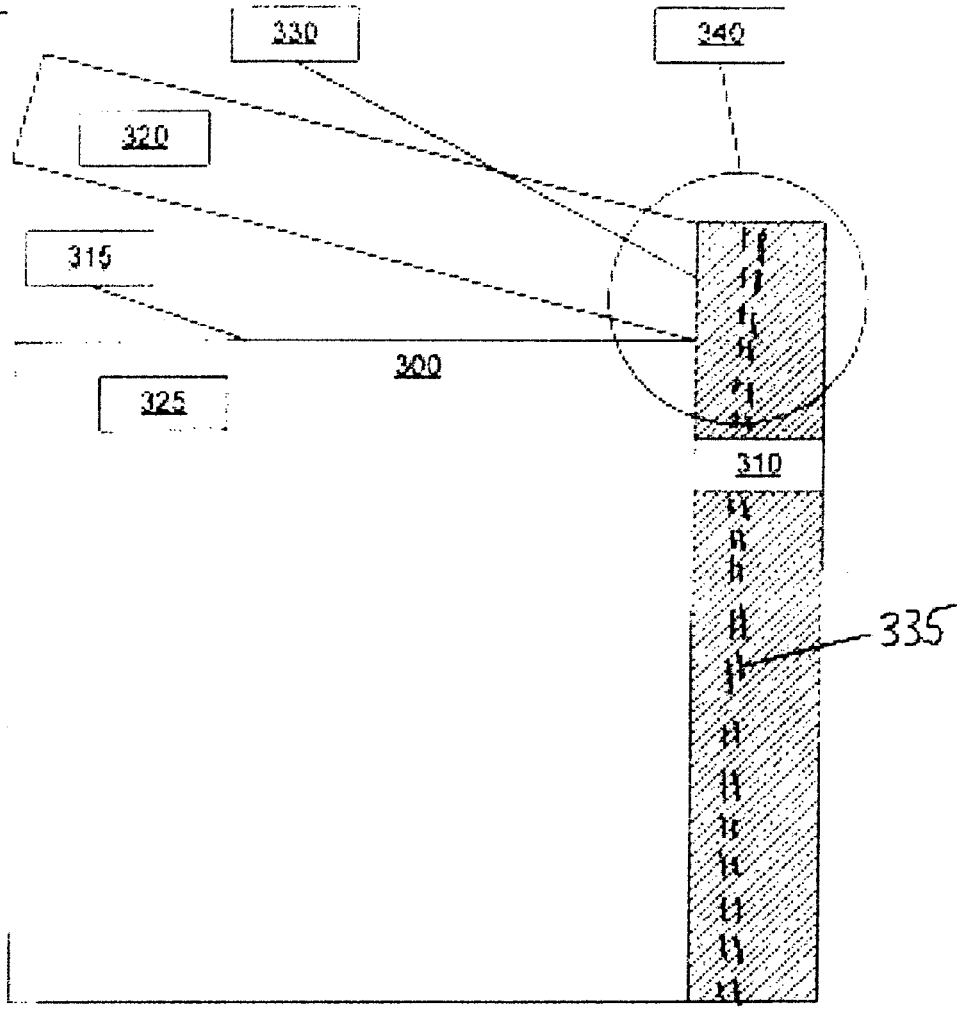
FIG. 3 illustrates the container of FIG. 1 when a top portion has been torn in order to dispense the product held within the container.

FIG. 3 illustrates a diagram of the resistive container 300 after the top portion of the packet 320 has been torn in order to open container 300. As illustrated, a top portion 320 is torn along axis 315 until the torn portion reaches the resistive portion 310 of the container 300. As illustrated in FIG. 3, the resistive portion 310 prevents the top portion 320 from being removed from central body portion 325 of container 300. Advantageously, as illustrated in FIG. 3, the resistive portion is disposed along a lateral edge of the container. A close-up view of the resistive portion 340 is illustrated in FIG. 4.

Figure 4:
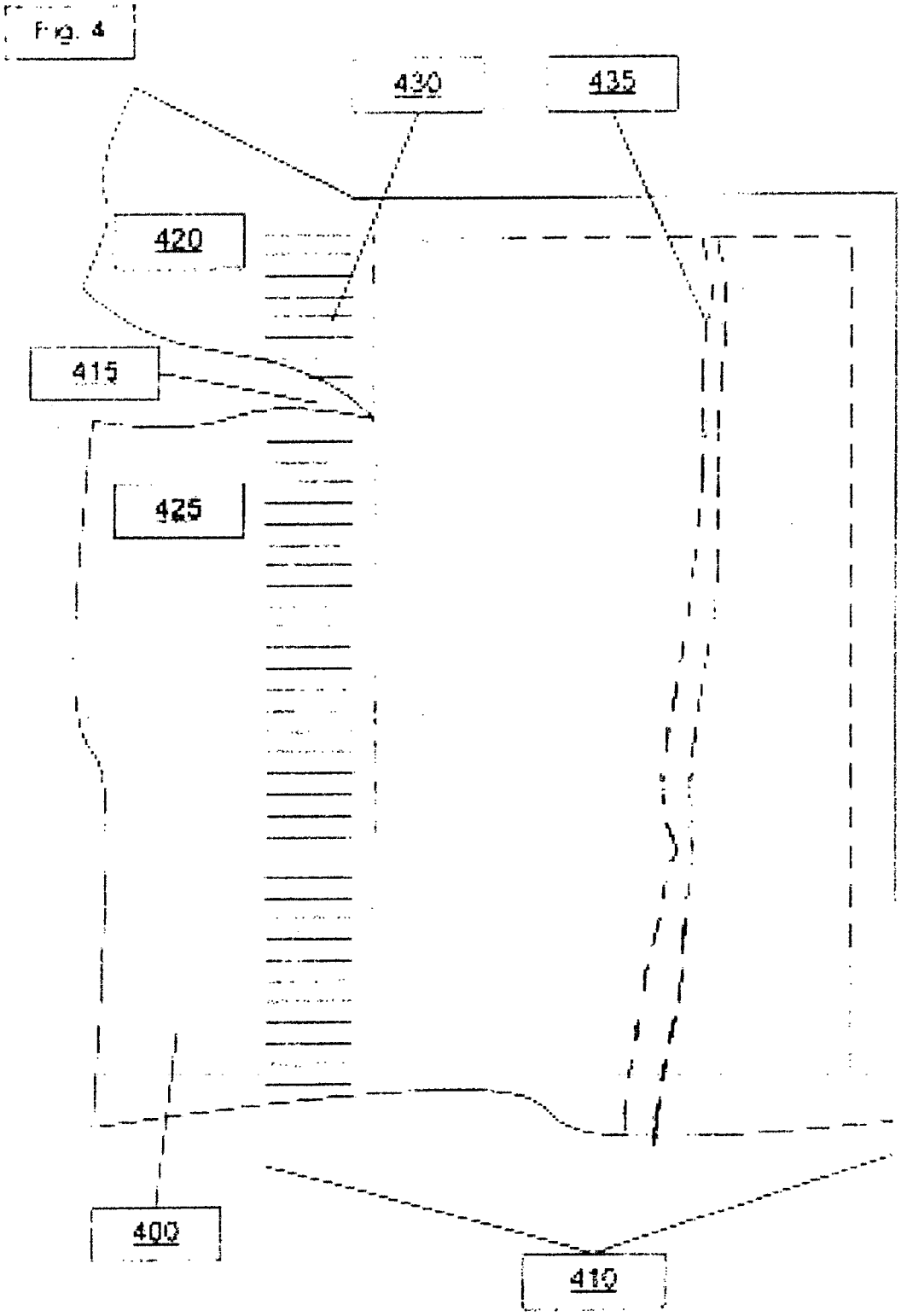
FIG. 4 illustrates a close-up view of a torn portion of the container illustrated in FIG. 3.

As shown in FIG. 4, the container's top portion 420 is torn from the main body 425 until the resistive portion 410 is encountered. The top portion 420 is torn in order to open and dispense the material inside the container 400. The top portion 420 is separated from the main body portion 425 along a tearing axis that extends substantially parallel to the top edge of the container, but not beyond the resistive portion 410. In the embodiment illustrated in FIG. 4, the resistive portion 410 includes tear-resistant thread 435 to prevent the top portion 420 from being separated from the body portion 425. After being used, the container 400 may be disposed of as a single piece of trash. As shown in FIG. 4, the tear resistant thread 435 may be secured within the container by crimping the container along vertical line 430 adjacent to the tear-resistant thread 435. In other embodiments of the invention, the tear-resistant thread may be fixed to the lateral edge on the container, itself.

Figure 5:
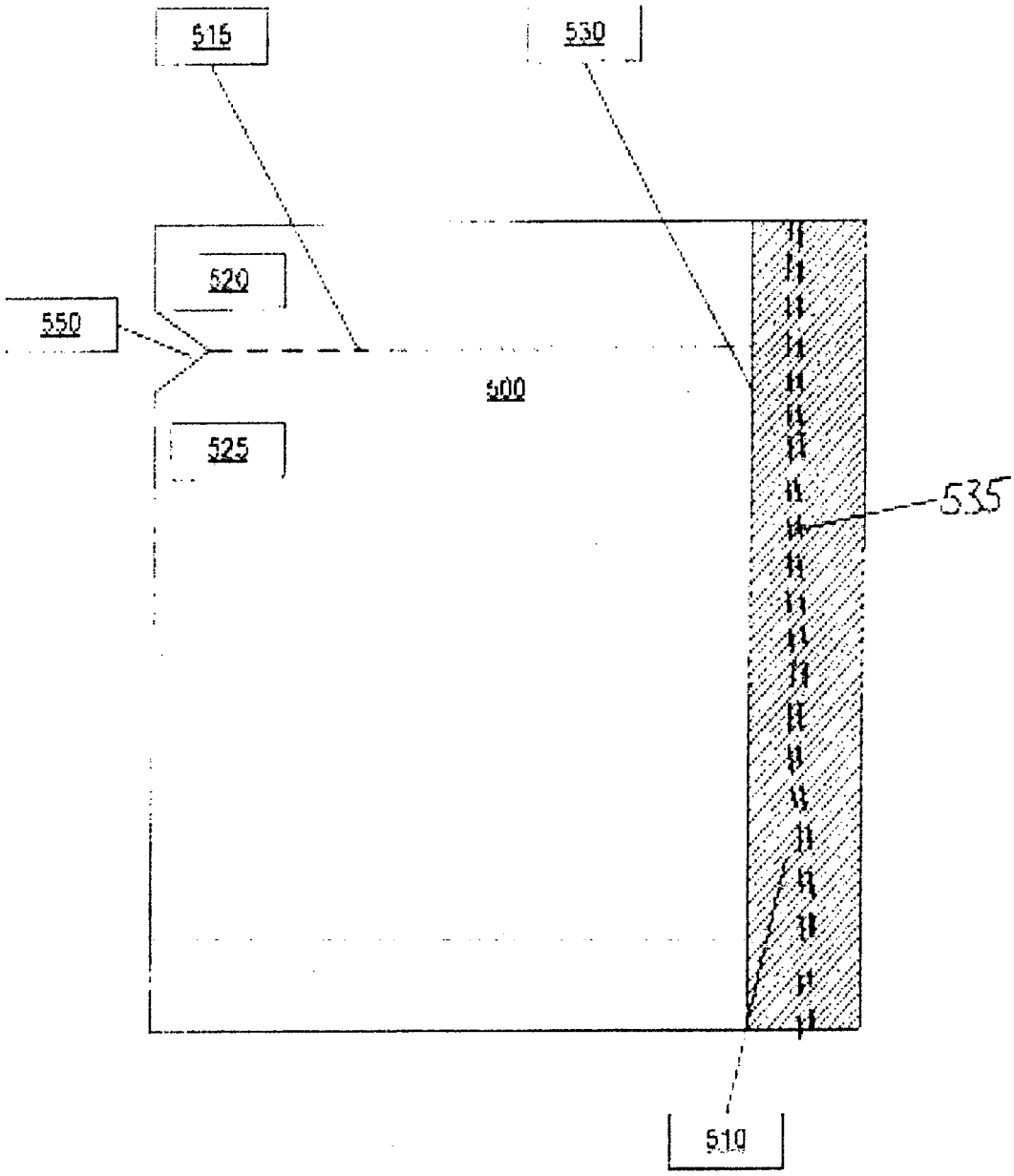
FIG. 5 illustrates a resistive container according to an alternate embodiment of the invention.

FIG. 5 illustrates additional implementations of the invention, wherein the container 500 is configured with additional features to facilitate opening the container along a pre-defined tearing axis. There is a balance between creating a container that is easy to firmly grasp in order to open the container using two hands and maximizing the storage capacity of the container (i.e., in order to prevent the contents from spilling, the container will be filled to a point well below a tearing axis). This can be achieved by configuring the container with a pre-defined tearing axis and ensuring that the container is opened along that axis.

As shown in FIG. 5, the container is configured with the additional features in order to ensure that the container is opened along a tearing axis. For example, the container 500 may be formed with perforations in the surface along the tearing axis 515. The surface perforations help to guide the separating of the top portion 520 from the main body portion 525 along a predetermined axis. Additionally, the container may be formed with an opening indentation 550. The opening indentation 550 enables a user to firmly grasp both the top and the body portions (520 and 525) of the container, and thereby easily apply the proper pressure necessary to open container 500 along the tearing axis 515 until the resistive portion 510 is encountered.

The entirety of this disclosure (including the Cover Page, Title, Headings, Field, Background, Summary, Brief Description of the Drawings, Detailed Description, Claims, Abstract, Figures, and otherwise) shows by way of illustration various embodiments in which the claimed inventions may be practiced. The advantages and features of the disclosure are of a representative sample of embodiments only, and are not exhaustive and/or exclusive. They are presented only to assist in understanding and teaching the claimed principles. It should be understood that they are not representative of all claimed inventions. As such, certain aspects of the disclosure have not been discussed herein. That alternate embodiments may not have been presented for a specific portion of the invention or that further undescribed alternate embodiments may be available for a portion is not to be considered a disclaimer of those alternate embodiments. It will be appreciated that many of those undescribed embodiments incorporate the same principles of the invention and others are equivalent. Thus, it is to be understood that other embodiments may be utilized and functional, structural and/or configuration modifications may be made without departing from the scope and/or spirit of the disclosure. As such, all examples and/or embodiments are deemed to be non-limiting throughout this disclosure. Also, no inference should be drawn regarding those embodiments discussed herein relative to those not discussed herein other than it is as such for purposes of reducing space and repetition. Some features are applicable to one aspect of the invention, and inapplicable to others. In addition, the disclosure includes other inventions not presently claimed. Applicant reserves all rights in those presently unclaimed inventions including the right to claim such inventions, file additional applications, continuations, continuations in part, divisions, and/or the like thereof. As such, it should be understood that advantages, embodiments, examples, functional, features, configurations, and/or other aspects of the disclosure are not to be considered limitations on the disclosure as defined by the claims or limitations on equivalents to the claims.

I claim:

1. A container for dispensing goods comprising:

a first hollow body portion configured to store product;

a second hollow body portion separated from the first hollow body portion by a crimp formed on a first container axis, wherein the second hollow body portion includes a secured tear-resistant thread disposed therein positioned adjacent to the crimp, and a second tear axis that approaches the crimp in a direction generally transverse to the crimp, wherein container integrity is maintained as a single piece when a consumer tears open the first hollow body portion along the second tear axis.

2. The container of claim 1, wherein the thread is secured within the second hollow body portion by the crimp.

3. The container of claim 1, wherein sides of the container are fused to secure the tear-resistant thread in place.

4. The container of claim 1, wherein the container is configured with an indentation along the tear axis.

5. The container of claim 4, wherein the container is configured with perforations along the tear axis.

6. The container of claim 5, wherein the tear axis is formed substantially parallel to a top portion of the container from the opening indentation to the second hollow body portion.

* * * * *